United States Patent [19]

Igarashi et al.

[11] 4,091,462

[45] May 23, 1978

[54] CONTROL APPARATUS FOR MORTAR COMPOUNDING APPARATUS

[75] Inventors: Isaburo Igarashi, Mishima; Kazuriki Iizuka, Morioka; Hiroshi Otsuka, Yokohama, all of Japan

[73] Assignees: Toto Electric Industry Co.; Japanese National Railway, both of Tokyo, Japan

[21] Appl. No.: 720,825

[22] Filed: Sep. 7, 1976

[30] Foreign Application Priority Data

Sep. 23, 1975 Japan ..... 50-114315

[51] Int. Cl.[2] ..... B28C 7/12

[52] U.S. Cl. ..... 366/17; 366/64; 366/151; 366/251

[58] Field of Search ..... 259/154, 149, 178 R, 259/178 A; 73/59

[56] References Cited

U.S. PATENT DOCUMENTS

| | | | |
|---|---|---|---|
| 2,679,750 | 6/1954 | Brookfield | 73/59 |
| 3,129,928 | 4/1964 | Huntington | 259/154 |
| 3,727,894 | 4/1973 | Ahrenberg | 259/154 |
| 3,826,476 | 7/1974 | Ahrenberg | 259/154 |

*Primary Examiner*—Billy S. Taylor

*Attorney, Agent, or Firm*—Spensley, Horn & Lubitz

[57] ABSTRACT

In a mortar compounding apparatus wherein water, cement, aggregate and sand are admitted into a mixing tank at a predetermined ratio and admixed to form mortar, there is provided a control apparatus including detection blades rotated by a constant torque motor via a spring in the mixing tank or a detection tank connected thereto. The load imposed on the detection blades by the mortar is detected by a potentiometer for controlling the amount of water or solid constituents admitted into the mixing tank.

5 Claims, 7 Drawing Figures

CONTROL APPARATUS FOR MORTAR COMPOUNDING APPARATUS

BACKGROUND OF THE INVENTION

This invention relates to mortar compounding apparatus, and more particularly to a control device of mortar compounding apparatus capable of providing an optimum mixing ratio of the constituents of motor, i.e., water, cement, sand supplied to a mixing tank.

Mortar is generally applied not only to the outer walls of buildings, but also to the inner walls of tunnels as well as cliffs so that it is necessary to bond the mortar to such surfaces with a strong bonding force. Accordingly, it is necessary to assure an optimum mixing ratio of the ingredients. When blasting mortar against the surfaces to be finished, the weight or volume of the respective ingredients is measured and then the measured ingredients are mixed together by a mixer.

However, such batch system in which measuring and compounding of the ingredients are repeated for respective batches is not suitable for buildings or civil works which require a large amount of mortar. Thus, the batch system not only greatly decreases the efficiency of the construction work but also requires a large labor and time.

To eliminate these disadvantages it has been proposed a continuous system wherein the weights of the ingredients such as cement, sand and aggregate are weighed while they are conveyed by a conveyor and the amount of water supplied to the mixer is controlled in accordance with measured weights. However, under a certain circumstance it is necessary to convey the mortar through a long pipe to a place at which the mortar is blown. In another case, it is impossible to use a conveyor. For this reason, the continuous system is not applicable to such applications. Further, in order to prepare mortar of high quality it is necessary to take into consideration not only the weights of the cement, aggregate and sand but also such other factors as the grain size of the aggregate and sand and the property of the cement. Thus, it is impossible to prepare high quality mortar with the continuous system described above in which the quantity of water is determined in accordance with the weights of the solid ingredients.

When water, aggregate, sand and cement are mixed together by a mixer, the force acting upon the blades of the mixer varies depending upon the ratio of mixing of these ingredients.

We have found that there is a definite relation between the force acting upon the blades of a mixer and the desired properties of the mortar, that is the strength and the rebound or splash of the applied mortar, and according to this invention, the force acting upon the blades is used to control the mixing ratio of the ingredients of mortar.

SUMMARY OF THE INVENTION

Accordingly, it is a principal object of this invention to provide a novel apparatus for compounding mortar capable of setting the ratio at an optimum value necessary to prepare high quality mortar.

Another object of this invention is to provide novel apparatus for compounding mortar which has a simple construction but can mix together various ingredients of the mortar at an optimum ratio thus preparing high quality mortar.

Still another object of this invention is to provide novel apparatus for automatically compounding various ingredients of mortar at a high efficiency.

According to this invention, these and further objects can be accomplished by providing a mortar compounding apparatus of the type wherein water and the solid ingredients of the mortar are admitted into a mixing tank at a predetermined ratio and admixed to form mortar, characterized in that there is provided a control apparatus including detection blades rotated at a constant torque in the mortar, means for detecting the load imposed upon the detection blades by the mortar, and a control device controlled by the detecting means for controlling the quality of at least one of the water and the solid ingredients supplied to the mixing tank.

The detection blades are installed in the mixing tank or a detection tank connected thereto and driven by a constant torque motor through a spring. The means for detecting the lead comprises a potentiometer or a photo-electric converting element arranged to detect the twisting angle of the spring.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
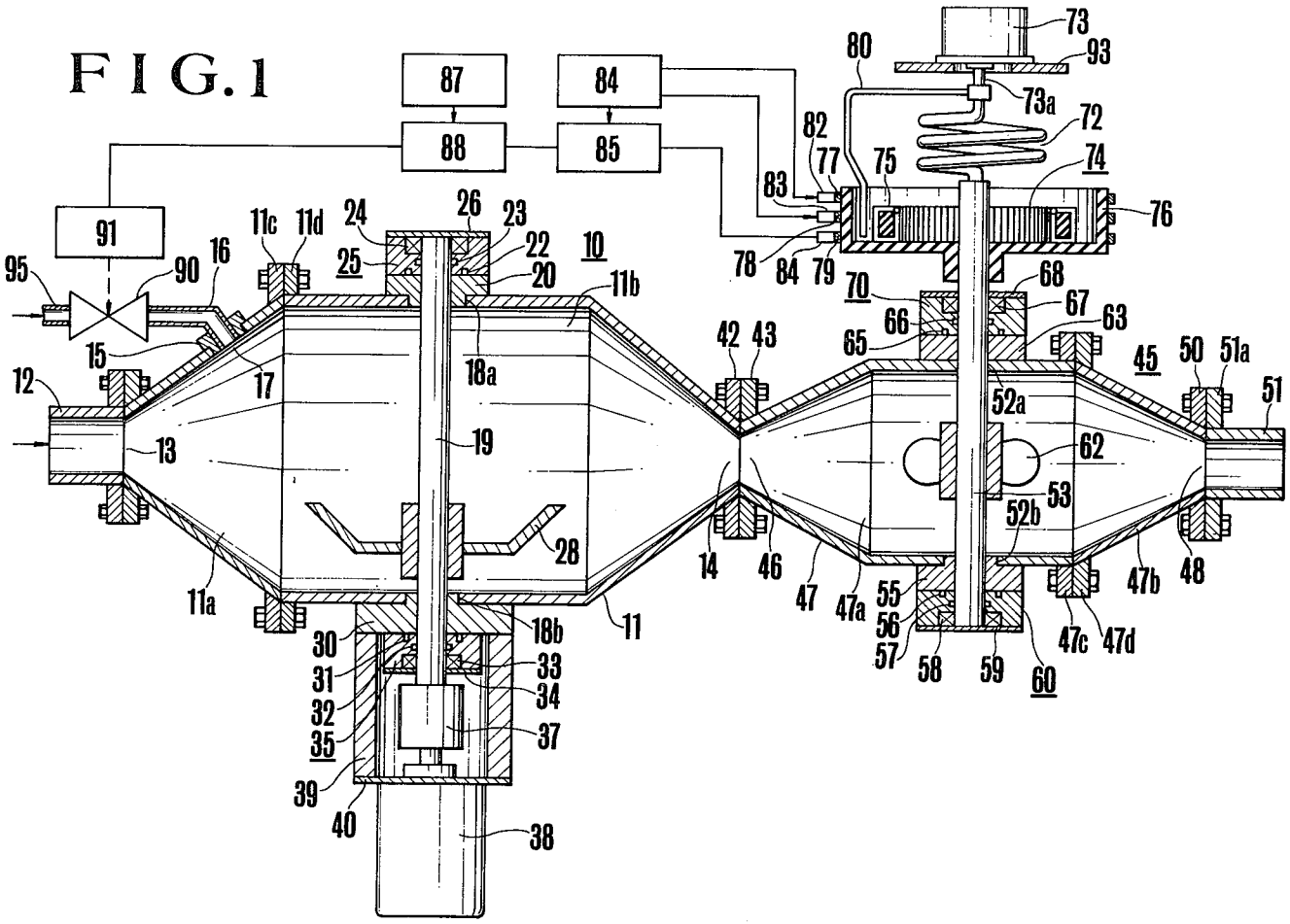
FIG. 1 is a sectional view of one example of the control apparatus of this invention as applied to a mortar compounding apparatus.

In FIG. 1 illustrating a preferred embodiment of this invention, a mixer 10 comprises a hollow tank 11 constituted by two sections 11*a* and 11*b* which are connected together by flanges 11*c* and 11*d* and bolts. The tank 11 is provided with an inlet opening 13 at one end to which the solid ingredients of mortar, i.e., cement, aggregate and sand are supplied through a pipe 12 and a discharge opening 14 at the other end for discharging mixed mortar, and a water inlet port 17 to which a water supply pipe 16 is connected through a bushing 15. Further, the tank 11 is provided with vertically aligned openings 18*a* and 18*b* for receiving a vertical shaft 19. The upper end of the shaft 19 is rotatably journalled by a metal bushing 20 fitted in the opening 18*a*. The upper end is also rotatably supported by a bearing member 25 including a bearing 24 secured to the shaft 19 and two O-rings 22 and 23. The upper end of the bearing member 25 is closed by a cover 26. Blades 28 are secured to the shaft 29 for stirring the ingredients of the mortar. The shaft and the blades are rotated at a speed of 50 r.p.m., for example. The lower end of the shaft 19 is rotatably journalled by a metal bushing 30 fitted in the opening 18*b*, and extends downwardly through a bearing member 35 including a bearing 33 secured to the shaft, two O-rings 31 and 32 and a cover 34. The lower end of the shaft 19 is coupled to driving motor 38 through a coupling member 37, the motor being secured to the metal bushing 30 through a cylindrical member 39 and a supporting plate 40.

The mixer tank 11 is connected with a detection tank 45 through flanges 42 and 43 so as to align its inlet port 46 with the discharge port 14. The detection tank 45 comprises a hollow housing 47 comprising two sections 47*a* and 47*b* which are bolted together through flanges 47*c* and 47*d*. The detection tank is provided with a discharge port 48 connected to a discharge nozzle, not shown, through flanges 50 and 51*a* and a pipe 51. The housing 47 is provided with vertically aligned openings 52*a* and 52*b* to receive a rotary shaft 53. The lower end of this shaft is rotatably journalled by a metal bushing 55 fitted in opening 52*b* and rotatably suported by a bearing member 60 including a bearing 58 secured to the shaft 53 and two O-rings 56 and 57. At about the center of the shaft are secured blades 62 adapted to stir the mortar in the detection tank 45 and to measure the force acting upon the blades 62. The upper end of shaft 53 is rotatably journalled by a metal bushing 63 fitted in the opening 52*a* and a bearing member 70 including a bearing 67 secured to the shaft 53, two O-rings 65 and 66 and a cover 68. The upper end of shaft 53 is connected via a coil spring 72 to the shaft 73*a* of a constant torque motor 73 supported by a support 93. The motor 73 rotates the detection blades 62 at a speed of 14 r.p.m., for example. Between the lower end of the spring 72 and the bearing member 70 is provided a trocoidal toroidae coil 75 of a potentiometer 74 and a current collecting ring 76 in the form of a bottomed cylinder. Three slip rings 77, 78 and 79 are mounted on the outside of the current collecting ring 76 via insulators. Slip rings 77 and 78 are connected to the opposite ends of the potentiometer coil 75. A sliding arm 80 sliding along the periphery of the potentiometer coil 75 is secured to the shaft 73*a* and is electrically connected to slip ring 79 via spring 72 and shaft 53 by means not shown in the drawing. The potentiometer coil 75 is secured to the inner bottom of the ring 76 by suitable means.

Figure 2:
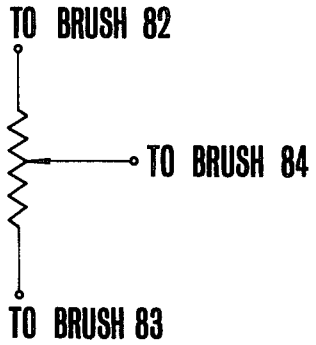
FIG. 2 is a connection diagram showing a potentiometer utilized in the control apparatus shown in FIG. 1.

FIG. 2 shows the electric connection of the potentiometer. The resistance value of the potentiometer is 10 K ohms for example.

Brushes 82 and 83 cooperating with slip rings 77 and 78, respectively, are connected to a voltage stabilizer 84 for energizing the potential coil with a constant voltage while the remaining brush 84 cooperating with the slip ring 79 is connected to a current converter 85 for converting a voltage variation or the voltage variation created by the movement of the sliding arm 80 into a current variation of from 2 to 10 ma, for example, for the purpose of preventing variations in the signal value caused by the variation in the length of the wiring. The current converter 85 may be of any well known type and is supplied with a DC bias from the voltage stabilizer 86 or a source of constant voltage. The output of the current converter 85 is compared by a comparator 88 with a reference signal from a reference source 87 having a construction that the reference signal can be varied manually. The output of the comparator 88 is sent to a control device 91 for a valve 90 connected in the water supply pipe 16 so as to variably open the valve in accordance with the magnitude of the output of the comparator 88.

Although not shown in the drawing the mixer tank and the detection tank are mounted on a stationary support.

The apparatus shown in FIG. 1 operates as follows. Water and solid ingredients of the mortar are supplied into the mixer tank 10 via pipes 16 and 12 and stirred and admixed by vanes 28. The compounded mortar is then transferred into the detection tank 45 under a suitable pressure. After stirred again by the detection blades 62, the mortar is supplied to the nozzle via pipe 51 to be blown against the wall of a building or cliff.

Figure 3:
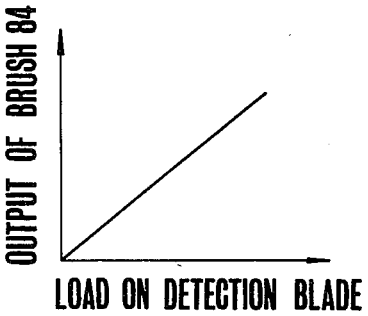
FIG. 3 is a graph showing the relationship between the load acting upon detection blades shown in FIG. 1 and the output of the potentiometer.

When the detection blades 62 are driven by the constant torque motor 73, a load required to stir the mortar is imposed upon the detection blades 62. Depending upon the magnitude of this load, the spring 72 twists more or less thus rotating the sliding arm 80 around the potentiometer coil 75 with the result that a fractional voltage corresponding to the twisted angle is taken out from brush 84. The components described above are set that the output from brush 84 becomes zero when mortar of a desired quality and consistency is formed by suitable ratio of the ingredients. Such adjustment can be made by the adjustment of the stiffness of the spring, the mounting position of the potentiometer coil and the angular position of the brush 84. Then, when the quantities of cement, aggregate and sand admitted through inlet port increase so that as the load imparted upon the detection blades 62 increases, the twisting angle of the spring 72 increases thereby rotating the sliding arm 80 over a larger angle. For this reason, the relationship between the load on the detection blades 62 and the output of brush 84 can be shown by a straight line shown in FIG. 3. The signal taken out through brush 84 is converted into a current signal which is compared with a reference signal from the reference source 87 by comparator 88 for applying a control signal to the valve control device 91. Thus, the opening of valve 90 is increased according to the magnitude of the control signal, thus increasing the quantity of water supplied to the mixer tank.

Figure 4:
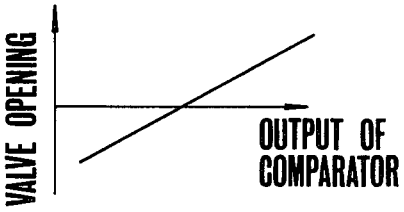
FIG. 4 is a graph showing the relationship between the output of a comparator and the degree of opening of a water supply value shown in FIG. 1.

The relationship between the degree of opening of valve 90 and the output of the comparator is shown by a straight line shown in FIG. 4. The supply of water is continued until the ratio of ingredients becomes to the desired value and the output from brush 84 becomes to zero. When the quantities of the sand, cement and aggregate decrease, the load on the detection blades 62 decreases and the twisting angle of spring 72 and the output from brush 84 decrease also. Consequently, the control signal from the comparator 88 decreases to close valve 90 thus decreasing the quantity of water. In this manner, it is possible to compound mortar having a desired composition and consistency.

One example of a preferred ratio of mixing is: 347 kg of cement, 638 kg of sand, 1220 kg of aggregate and 156 kg of water. This ratio can be assured by controlling the quantity of water by the control apparatus of this invention.

As above described, according to this invention, since the quantities of the mortar ingredients supplied to the mixing tank are controlled by detection blades imposed thereon by the mortar in a detection tank, it is possible to prepare mortar having a constant mixing ratio of high operating efficiency. In addition, the apparatus of this invention has relatively simple construction so that it can be manufactured at a low cost.

Figure 5:
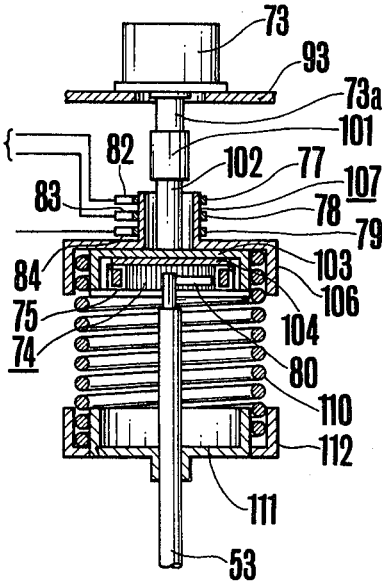
FIG. 5 is a sectional view showing a modified spring and a potentiometer.

FIG. 5 shows a modified embodiment of this invention in which elements corresponding to those shown in FIG. 1 are designated by the same reference numerals. In this modification the shaft 73a of the constant torque motor 73 is connected to the bottom of an inverted cup shaped member 103 via a coupler 101 and a shaft 102. The coil 75 of the potentiometer 74 is secured to the inner surface of the inverted cup shaped member 103 through an electric insulator 104. The sliding arm 80' of the potentiometer is mounted on the upper end of shaft 53 to be rotated around the potentiometer coil by the load on the detection blades (see FIG. 1). A current collecting ring 107 in the form of an inverted cup having a larger diameter than the inverted cup shaped member 103 is provided to surround the same, and the upper end of the coil spring 110 is clamped between two inverted cup shaped members 103 and 107. The lower end of the spring is clamped between a cup shaped member 111 secured to the shaft 53 and a clamping member 112 secured to the cup shaped member 111.

With the construction described above, when the load on the detection blades is different from a predetermined value, the spring is twisted in accordance with the difference so that the sliding arm is rotated to produce a control signal to decrease the difference to zero.

Instead of controlling the quality of water, the object of this invention can also be accomplished by controlling the quantity of solid ingredients, that is cement, sand and aggregate.

Such control may be made in accordance with not only the quantities of the ingredients but also with the change in the property of the aggregate, particle size and water content of the sand.

Where a pipe is connected between the mixing tank and the detection tank, it is possible to locate the latter at any desired position. Further, instead of providing a detection tank for mounting the detection blades, the detection blades may be mounted in the mixing tank near its discharge port. Further, the shaft 19 may be connected to its driving motor 38 via a coil spring to use the blade 28 also as the detection blades.

Instead of using a potentiometer, the twist or distortion of the spring can be detected by other suitable means such as a photoelectric converting element.

Figure 6:
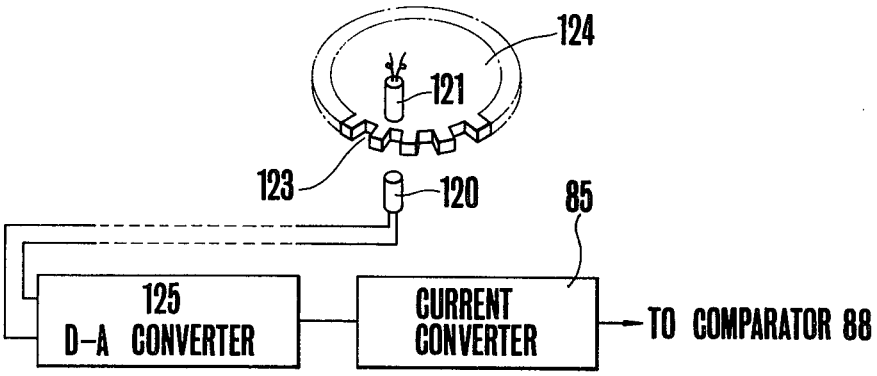
FIG. 6 is a view showing a modified embodiment wherein the torsion of a spring is detected by a photoelectric converting element.

FIG. 6 shows such modification which comprises a disc 124 secured to shaft 73a (see FIG. 1) and provided with a plurality of teeth or openings uniformly spaced in the circumferential direction, and a light source 121 and a photoelectric converting element 120 which are disposed on the opposite sides of the disc 124. As the disc 124 is rotated in accordance with the load on the detection blades the light is intercepted by the teeth 123 to produce a pulse current which is applied to current converter 85 through a digital-analogue converter 125.

The spring 72 may be made of elastic bar having circular or rectangular cross-section.

Figure 7:
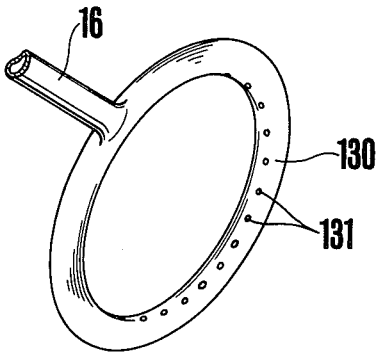
FIG. 7 is a perspective view showing one example of an annular pipe for uniformly supplying water to mortar in a mixer.

FIG. 7 shows a perspective view of an annular pipe 130 which may be used to uniformly sprinkle water in the mixing tank. As shown, the annular pipe 130 is connected to the water feed pipe 16 and provided with a plurality of water ejecting openings 131 directed to the center. The pipe 130 is mounted along the inner periphery of the mixing tank so that the ingredients of the mortar pass through the annular pipe.

What is claimed is:

1. In a mortar compounding apparatus of the type wherein water and solid ingredients of mortar are admitted into a mixing tank at a predetermined ratio and admixed to form mortar and a detection tank which is coupled to the output port of said mixing tank so as to contain compounded mortar, the improvement which comprises a control appraratus comprising:

detection blades provided in said detecting tank;

a constant torque motor for rotating said blade via a coil spring;

means for detecting the load imposed upon said detection blades by said mortar, said detecting means comprising:

an annular potentiometer having a sliding arm connected to a shaft of said constant torque motor, said annular potentiometer being mounted on the bottom of a cup shaped support secured to a shaft for supporting said detection blades; and means for deriving out a fractional voltage produced by the relative rotation of said potentiometer and said sliding arm, said deriving means comprising a plurality of slip rings mounted on the periphery of said cup shaped support for supplying a constant voltage across said potentiometer and for deriving out said fractional voltage proportional to the relative angular movement of said potentiometer and said sliding arm; and a control device controlled by said detecting means for controlling the quantity of at least one of said water and solid ingredients supplied to said mixing tank.

2. The improvement according to claim 1 which further comprises a current converter for converting the output from said detecting means into a current signal and a comparator for comparing said current signal with a predetermined reference signal for producing a control signal applied to said control means.

3. The improvement according to claim 1 wherein said control means comprises a valve in a pipe for supplying water to said mixing tank.

4. In a mortar compounding apparatus of the type wherein water and solid ingredients of mortar are admitted into a mixing tank at a predetermined ratio and admixed to form mortar and a detection tank coupled to the outlet port of said mixing tank so as to contain compounded mortar, the improvement which comprises control apparatus comprising:

detection blades provided in said detection tank;

a constant torque motor for rotating said blades via a coil spring;

means for detecting a load imposed upon said detection blades by said mortar, said detecting means comprising:

a first inverted cup shaped member connected to the lower end of said rotating shaft of said constant torque motor;

a second inverted cup shaped member surrounding said first inverted cup shaped member, said first and second inverted cup shaped members clamping thereinbetween said coil spring;

an annular potentiometer having a sliding arm coupled to the rotating shaft of said constant torque motor, said annular potentiometer being mounted inside of said first inverted cup shaped member and said sliding arm being supported by a shaft carrying said detection blades; and means for deriving out a fractional voltage produced by the relative rotation of said potentiometer and said sliding arm, said deriving means comprising a plurality of slip rings provided on said second inverted cup shaped member for supplying a constant voltage across said potentiometer and for deriving out said fractional voltage proportional to the relative rotation of said potentiometer in said sliding arm; and a control device controlled by said detecting means for controlling the quantity of at least one of said water and solid ingredients supplied to said mixing tank.

5. In a mortar compounding apparatus of the type wherein water and solid ingredients of mortar are admitted into a mixing tank at a predetermined ratio and admixed to form mortar, the improvement which comprises a control apparatus comprising:

detection blades in said mortar, a constant torque motor for rotating said blades via a coil spring;

means for detecting the load imposed on said detection blades by said mortar, said detection means comprising:

a disc provided on a rotating shaft of said constant torque motor and having a plurality of openings about the periphery thereof; and a light source and a photoelectric converting element disposed on opposite sides of said disc for providing a pulse current when said disc is rotated in accordance with the load imposed upon said detection blades; and a control device controlled by said detecting means for controlling the quantity of at least one of said water and solid ingredients supplied to said mixing tank.

* * * * *